United States Patent [19]

Van Soest et al.

[11] Patent Number: 4,750,853

[45] Date of Patent: Jun. 14, 1988

[54] DEVICE FOR CONVEYING A BUNDLE OF SHEETS

[75] Inventors: Hendrikus J. Van Soest, Helden; Ronald P. In 't Zandt, Venlo, both of Netherlands

[73] Assignee: Oce-Nederland B.V., Venlo, Netherlands

[21] Appl. No.: 930,722

[22] Filed: Nov. 13, 1986

[30] Foreign Application Priority Data

Nov. 21, 1985 [NL] Netherlands ..... 8503203

[51] Int. Cl.[4] ..... B65H 31/30

[52] U.S. Cl. ..... 414/43; 198/624; 271/220; 271/246

[58] Field of Search ..... 198/624; 271/207, 220, 271/246, 273, 274; 414/43

[56] References Cited

U.S. PATENT DOCUMENTS 3,076,196 2/1963 Mestre ..... 271/221 X
3,618,934 11/1971 Germuska ..... 271/274
4,453,870 6/1984 Bean ..... 271/220 X
4,618,302 10/1986 Kokubo et al. ..... 271/273 X
4,621,966 11/1986 Luperti et al. ..... 414/43

OTHER PUBLICATIONS

"Paper Feed Mechanism", IBM Technical Disclosure Bulletin, vol. 24, No. 7B, 12-1981.

*Primary Examiner*—Robert J. Spar
*Assistant Examiner*—Janice Krizek
*Attorney, Agent, or Firm*—Reed Smith Shaw & McClay

[57] ABSTRACT

The present invention relates to a device for collecting sheets into a bundle and then conveying the bundle to a subsequent location comprising two pairs of driveable rollers capable of forming a nip between each pair of rollers. The rollers come into contact with the bundle of sheets and form the nip only after the bundle is located in the nip forming area between the rollers. One pair of rollers always forms a nip with the bundle of sheets therein, thereby preventing the bundle from shifting and tearing. The timing and interaction between the two pairs of driveable rollers is described as well as their interconnections.

7 Claims, 3 Drawing Sheets

DEVICE FOR CONVEYING A BUNDLE OF SHEETS

FIELD OF THE INVENTION

The present invention relates to a device for collecting sheets into a bundle and conveying the bundle to a subsequent location.

BACKGROUND OF THE INVENTION

A simple device for conveying a bundle of sheets is shown in British Pat. No. 1,559,898. This device only uses one pair of rollers.

A device for conveying a bundle of sheets using two pairs of rollers is shown in U.S. Pat. No. 3,076,196. The device described therein feeds sheets between a first pair of rollers and collects the sheets against an abutment which is disposed in the conveyor path past the rollers. The two rollers are spaced some distance apart so that the sheets can be pushed unobstructedly between the rollers and against the abutment. When the required sheets have been collected, the abutment is removed from the conveyor path and the two rollers, one of which is driven, are pressed against one another so that the resulting bundle of sheets is conveyed onto a second driven roller pair also disposed in the conveyor path. The rollers of the second pair are resiliently pressed against one another and are pressed apart by the bundle of sheets when the bundle is conveyed by the first pair of rollers into the nip of the second pair of rollers.

The disadvantage of this device is that when the bundle of sheets is relatively thick the leading edge of the bundle (top and/or bottom) collides with the surface of the second pair of rollers relatively far in front of the nip. As the bundle is conveyed on into the nip, the sheets of the bundle can readily shift with respect to one another and be conveyed on through the nip and deposited in that shifted condition. This problem may have adverse effects particularly if the sheets positioned between the first pair of rollers are stapled in one corner. The second pair of rollers may then cause the top or bottom sheets to take a skew position and subsequently form a sharp fold in the sheets or tear them at the staple as they pass through the second pair of rollers.

Another device for conveying a bundle of sheets is shown in U.S. Pat. No. 4,453,870. The device described therein also feeds sheets between two pairs of rollers and against a moveable gate which is disposed in the conveyor path past the first pair of rollers. Once the bundle of sheets has been formed against the moveable gate, the first pair of rollers is moved together, pressing on the sheets and forming a nip. When this is done, the rollers of the second pair are automatically set to a distance from one another which is equal to the distance between the rollers of the first pair when the nip is formed. The gate is then moved and the bundle of sheets is conveyed by the first pair of rollers to the second pair of rollers and then to the finishing station.

Like the device described in U.S. Pat. No. 3,076,196 one or both of the leading edges of the bundle of sheets collides with a roller of the second pair upon entering the nip with the possibility of the outer sheets of the bundle becoming shifted with respect to each other. Although the rollers of the second pair are separated from each other by a distance equal to the nip between the rollers of the first pair, this separation is not sufficient to prevent collision with the rollers. This is because the distance between the rollers of the first pair when forming the nip must be somewhat smaller than the thickness of the bundle of sheets to properly convey it.

A further disadvantage of this device is that the collection of a new bundle of sheets can only begin when the preceding bundle has completely passed through the second pair of rollers due to the direct linkage between the first and second pairs of rollers.

It would be desirable to provide a device without these disadvantages and one wherein the nip is formed only after the bundle of sheets has entered the nip forming space.

SUMMARY OF THE INVENTION

The present invention provides a device for conveying a bundle of sheets comprising at least a first pair of driveable conveyor means which can together form a nip for the conveyance of a bundle of sheets and at least a second pair of driveable conveyor means which, as considered in the direction of conveyance, is disposed after the first pair of conveyor means and which can form a nip for the further conveyance of a bundle of sheets fed by the first pair of conveyor means wherein one of the second pair of conveyor means is connected to a control means and is moveable between a first position in which the second pair of conveyor means are free of one another for the unobstructed feeding of a bundle of sheets between them, and a second position in which the second pair of conveyor means forms a nip for the further conveyance of a bundle of sheets, and wherein the control means causes the second pair of conveyor means to move out of the first position into the second position when the first pair of conveyor means has fed the bundle of sheets between the second pair of conveyor means and into the nip forming area. Preferably the conveyor means are rollers. Each conveyor means can consist of a plurality of rollers.

In the device according to the present invention, the nip between the second pair of conveyor means is not formed until the bundle of sheets projects into the nip forming space between the second pair of conveyor means. As a result, this pair of conveyor means does not exert any forces on the bundle of sheets before the nip is formed. After the nip is formed, the only force exerted is the required conveying force.

In a simple and, hence, advantageous embodiment, the control means includes an arm and a drive means, and the top conveyor means of the first pair of driveable conveyor means is rotatably secured to an intermediate part of the arm, the top conveyor means of the second pair of driveable conveyor means is secured to a first end of the arm, and the drive means is connected to a second end of the arm for selectively (a) lifting the first end of the arm thereby turning the arm about the nip formed by the first pair of conveyor means and (b) for lifting the intermediate part of the arm thereby turning the arm about the nip formed by the second pair of conveyor means.

The result of this combination is that the bundle is always advanced controllably because at least one of the two nips is always formed, either: (a) the conveyor means of the first pair can be released from one another to collect sheets therebetween and form a bundle while the second pair of conveyor means forms a nip for possibly discharging a bundle formed beforehand, or (b) the conveyor means of the second pair can be released from one another while the first pair of conveyor means forms a nip for unobstructedly feeding the bundle of sheets between the second pair of conveyor means.

Another advantageous embodiment of the device according to the present invention includes a moveable abutment strip connected to a means for moving it between a first position in which sheets that are to be collected to form a bundle are retained in that part of the conveyor path in the collecting tray which is situated between the pairs of conveyor means, and a second, lifted position in which the sheets are not retained. The means moves the abutment strip from the first position to the second position just before the bundle of sheets begins to be conveyed and moves it back from the second position to the first position before the bundle has been conveyed over a distance equivalent to the distance between the first pair of conveyor means and the second pair of conveyor means, as measured in the direction of conveyance.

The effect of this combination and configuration is that the lifted abutment strip falls back onto the bundle of sheets soon after each start of the conveyance of a bundle since the sheets therein are typically longer than the distance between both conveying nips. After the trailing edge of the bundle has passed, the abutment falls back into the operative first position so that irrespective of the size of the bundle, a subsequent sheet arriving with a short break can be retained for the collection of a subsequent quantity of sheets to form a new bundle.

Other features and advantages of the present invention will be apparent from the following detailed description and the accompanying drawings of a presently preferred embodiment of the best mode of carrying out the invention.

DESCRIPTION OF THE PREFERRED EMBODIMENT

Figure 1:
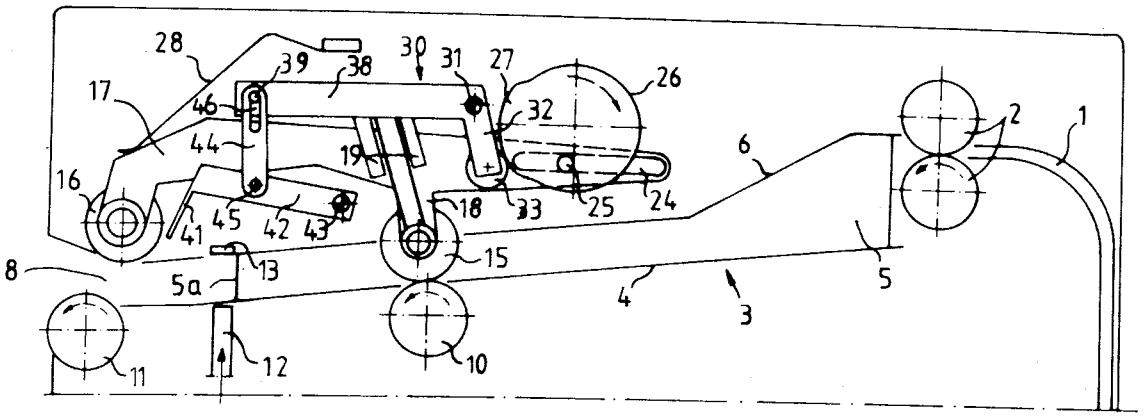
FIG. 1 is a side view of a device according to the present invention shown in the inoperative position.

In FIG. 1, copy sheets are fed from the copying section (not shown) of a copying machine along conveyor path 1. The end of conveyor path 1 is provided with a driveable conveyor roller pair 2. Conveyor path 1 leads into a collecting tray 3 formed by a baseplate 4, a side plate 5 extending in the direction of conveyance and a top plate 6.

At the side opposite to conveyor rollers 2, collecting tray 3 has an opening 8 along which copies can be fed from the copying machine and can be deposited in a collecting tray (not shown), such as a tray of the kind described in Dutch Patent Application No. 8500545 or its corresponding U.S. patent application Ser. No. 833,852, now U.S. Pat. No. 4,664,368.

Rollers 10 and 11 with their axes parallel to the axes of rollers 2 are driveable to convey the bundle of sheets and are disposed in openings in baseplate 4 in spaced relationship in the direction of conveyance. A stapling head 12 is disposed beneath baseplate 4 between drive rollers 10 and 11 and can be pressed against an anvil 13 via an opening in baseplate 4 in order to staple the sheets in collecting tray 3. The sheets which are to be stapled may be fed into tray 3 by conveyor rollers 2, or they may be introduced manually into opening 8, as explained in more detail in Dutch Patent Application No. 8501337 or its corresponding U.S. patent application Ser. No. 861,518, pending.

Pressure rollers 15 and 16, respectively, can come into pressure contact with drive rollers 10 and 11, respectively, to form conveying nips in which case they project through openings in top plate 6. Pressure roller 16 is mounted rotatably on one end of an arm 17. The other end of arm 17 has a slot 24 extending therein in the longitudinal direction. A pin 25 which fits in slot 24 is secured on a disc 26 which is rotatably secured to the device frame. Upon rotation of disc 26, pin 25 moves in a circular path during which arm 17 coupled to pin 25 via slot 24 is driven. Pressure roller 15 is rotatably secured to an arm 20 which is moveable to and fro in a linear guide 19 disposed in the device frame (not shown). Arm 17 is also rotatably secured on the shaft of pressure roller 15 via a projection 18 provided on the middle of arm 17. A leaf spring 28 is in pressure contact with the top of arm 17.

An abutment strip 41 which can project between drive roller 11 and stapling head 12 through an opening in top plate 6 and an opening in baseplate 4 is secured to an arm 42 rotatable about a pin 43 which is secured to the device frame. A link 44 is pivotally connected to arm 42 at one end by means of pin 45. A slot 46 is formed in the other end of link 44 and a pin 39 fits therein. This pin is secured to one end 38 of a bent arm 30 which is rotatable near the bent end about a pin 31 which is fixed to the frame. The other end 32 of bent arm 30 is provided with a rotatable roller 33 in contact with the edge of disc 26. The periphery of disc 26 has a projecting cam 27 which when considered in the circumferential direction extends over a relatively small part of the otherwise cylindrical disc.

The above-described device for conveying a bundle of sheets operates as follows. In the inoperative position of the device shown in FIG. 1, disc 26 occupies a position in which the end of arm 17 containing slot 24 is held in a bottom position by pin 25. When arm 17 is in this position, pressure roller 15 presses on drive roller 10 and pressure roller 16 is at some distance above drive roller 11. Also, in this inoperative position, cam 27 occupies a position in which, via arm 30, link 44 and arm 42, abutment strip 41 is lifted outside the conveyor path of collecting tray 3. In the position shown in FIG. 1, a bundle of sheets can be manually introduced into opening 8 as far as edge 5*a* of side plate 5, after which stapling head 12 can staple this bundle.

In order that copy sheets fed individually from conveyor path 1 may be made into bundles, the device performs a cycle of steps of which FIGS. 2A through 2E show a number of positions occupied consecutively.

Figure 2A:
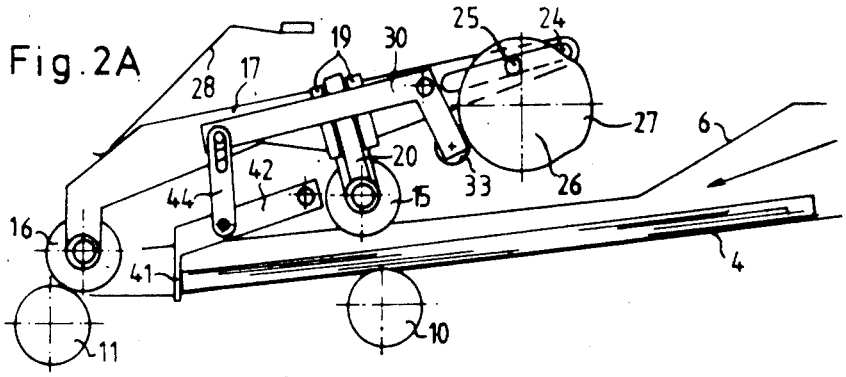
FIGS. 2A through 2E are side views of the device shown in FIG. 1 in a number of consecutive positions of a cycle.

At the start of such a cycle, disc 26 is put into the position shown in FIG. 2A, in which roller 33 is not in contact with cam 27. In this starting position, rollers 11 and 16 form a nip, rollers 10 and 15 are some distance apart, abutment strip 41 is in the operative position and conveyor rollers 2 feed sheets individually to collecting tray 3. The sheets are positioned on one another and against abutment strip 41 and against side plate 5 by a collecting means (not shown). The sheets extend into the nip forming area of rollers 10 and 15.

Figure 2B:
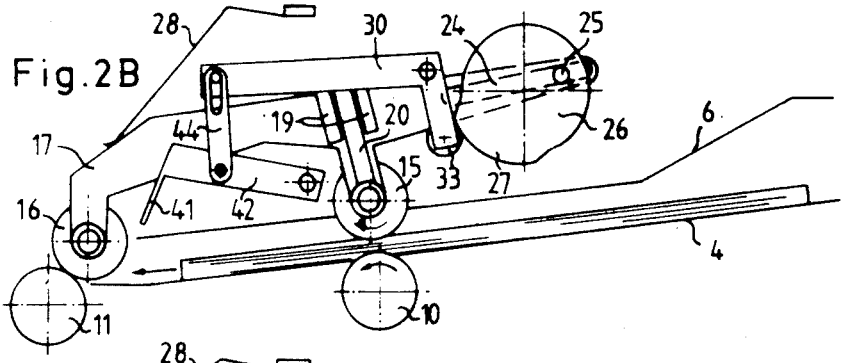

After the sheets have been collected to form a bundle, and stapled if required, the copying machine control system delivers a signal in response to which disc 26 is caused to rotate through one revolution, during which disc 26 successively occupies the positions shown in FIGS. 2B through 2E. From the starting position shown in FIG. 2A, the end of arm 17 containing slot 24 and pressure roller 15 move down until roller 15 comes into contact with the bundle of sheets collected in collecting tray 3. Before pressure roller 15 has come into contact with the bundle of sheets, cam 27 has come into contact with roller 33 and abutment strip 41 is lifted out of the conveyor path of collecting tray 3. Drive roller 10 now conveys the bundle of sheets pressed thereagainst past abutment strip 41 in the direction of roller pair 11 and 16 as shown in FIG. 2B.

Before the bundle of sheets reaches roller pair 11 and 16, disc 26 rotating further has turned arm 17 further in the same direction about the nip formed by pressure roller 15, drive roller 10 and the bundle of sheets thereby lifting pressure roller 16. The bundle of sheets is now fed unobstructedly into the nip forming area between rollers 11 and 16, which are disengaged from one another. As disc 26 rotates further, end 38 of arm 30 moves down and roller 33 disengages from cam 27 so that link 44 and arm 42 move downwardly under their own weight until abutment strip 41 encounters the top of the bundle of sheets.

Figure 2C:
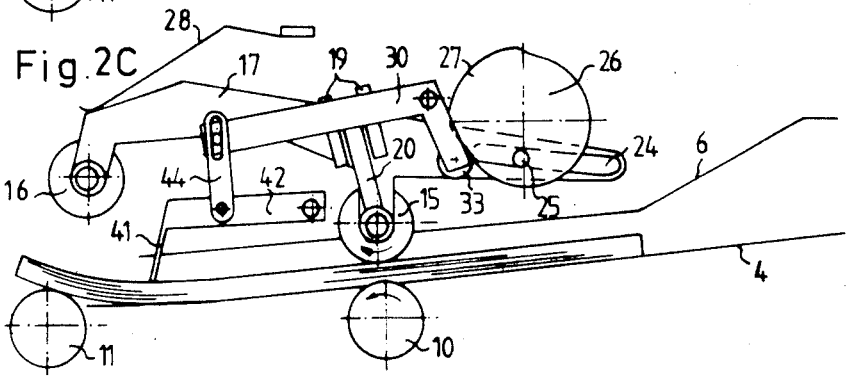
Figure 2D:
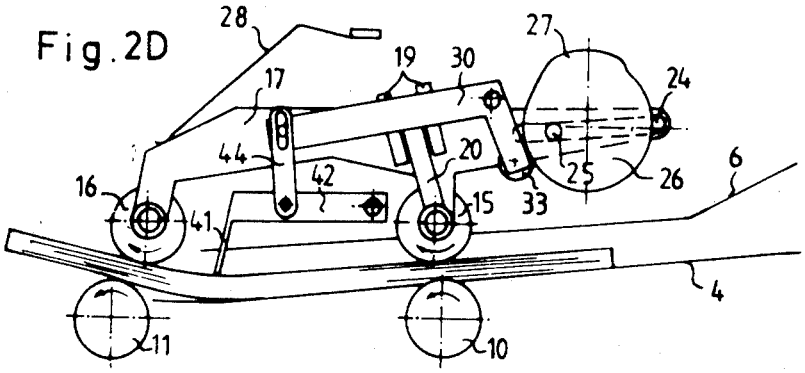

FIG. 2C shows the position now reached, in which pin 25 occupies its lowest position. With continuing rotation of disc 26, during which pin 25 moves in a generally upward direction, arm 17 turns back until pressure roller 16 comes into contact with the advancing bundle of sheets. FIG. 2D shows the instantaneous position in which the two roller pairs and 10 and 15 and 11 and 16 simultaneously form conveying nips.

As disc 26 continues to rotate, arm 17 turns about the nip formed by pressure roller 16, drive roller 11 and the bundle of sheets such that pressure roller 15 is disengaged from the bundle and only roller pair 11 and 16 form a conveying nip. Since at least one conveying nip is always formed, the sheets of the bundle cannot readily shift for any reason such as, for example, due to a positioning means which, in order to position the sheets against abutment strip 41 and side plate 5, continually presses on the top sheet of the bundle.

Figure 2E:
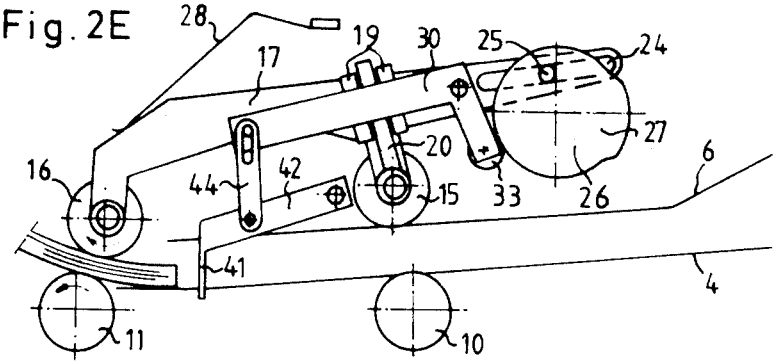

After the completion of one revolution, disc 26 stops. When the trailing edge of the bundle of sheets, now conveyed only by roller pair 11 and 16, has passed abutment strip 41, strip 41 can move down further by its own weight until it is in the same position it was at the start of the cycle. In this initial position, which is also shown in FIG. 2E, another set of sheets can be fed individually from conveyor path 1 to and against abutment strip 41 thereby forming another bundle while the last bundle is still being conveyed by roller pair 11 and 16.

When the trailing edge of the bundle of sheets has passed roller pair 11 and 16, pressure roller 16 drops onto drive roller 11 due to leaf spring 28 so that the cycle starting position is again reached.

The above-described device can also be arranged to place disc 26 from the inoperative position shown in FIG. 1 into the position shown in FIG. 2D and stop it, while a cam (not shown) holds arm 30 in the positon shown in FIG. 1. With this positioning, in which both roller pair 10 and 15 and roller pair 11 and 16 form nips and abutment strip 41 is outside the conveyor path of collecting tray 3, sheets supplied individually from conveyor path 1 can be fed over baseplate 4 of collecting tray 3 and directly out of the copying machine. With this latter positioning, the sheets are not collected into bundles.

Thus, the present invention relates to a device for collecting and conveying a bundle of sheets past a retractable abutment. In the peferred embodiment described above, a first pair of conveyor rollers 10 and 15 are disposed in front of abutment 41 and a second pair of conveyor rollers 11 and 16 are disposed after abutment 41. The top roller 15 of the first pair of rollers is rotatably secured to the middle of an arm 17 and the top roller 6 of the second pair of rollers is rotatably secured to one end of arm 17. The other end of arm 17 is provided with a slot 24. A pin 25, which can move along a circular path, fits in slot 24.

Upon one revolution of pin 25, arm 17 takes consecutively the following positions in which: (a) the first pair of rollers 10 and 15 are free from each other such that sheets can be collected therebetween in the nip forming area and against abutment 41, and the second pair of rollers 11 and 16 form a nip as shown in FIG. 2A; (b) the first pair of rollers 10 and 15 form a nip for the conveyance of the collected bundle past abutment 41 which is now retracted as shown in FIG. 2B; (c) the second pair of rollers 11 and 16 are free from each other for the unobstructed conveyance of the bundle of sheets therebetween, through the nip forming area, as shown in FIG. 2C; (d) the second pair of rollers 11 and 16 also form a nip when the bundle has been fed therebetween as shown in FIG. 2D; and (e) the first pair of rollers 10 and 15 are set free from each other, enabling the collection of a subsequent quantity of sheets in the nip forming area to form a new bundle while the preceding bundle is still being conveyed by the second pair of rollers 11 and 16 as shown in FIG. 2E.

During the cycle shown in FIGS. 2A through 2E, abutment 41 is tilted out of the conveyor path in collecting tray 3 in order to enable the leading edge of the bundle to pass (FIG. 2B) and is dropped thereafter onto the bundle (FIG. 2C) to block the conveyor path immediately after the bundle has completely passed abutment 41 (FIG. 2E).

While presently preferred embodiments of the invention have been shown and described with particularity, the invention may be otherwise embodied within the scope of the appended claims.

What is claimed is:

1. In a device for conveying a bundle of sheets having at least a first pair of driveable conveyor means which can together form a nip, and at least a second pair of driveable conveyor means disposed downstream from the first pair of conveyor means in a feeding direction and which can form a nip, the improvement comprising: one conveyor means of the second pair of conveyor means connected to a control means and being moveable between a first position in which the second pair of conveyor means are at a distance from one another which is greater than the thickness of the bundle of sheets for the unobstructed feeding of the bundle between them while the first pair of conveyor means forms a nip and a second position in which the second pair of conveyor means forms a nip for the further conveyance of the bundle, and wherein the control means causes one conveyor means of the second pair of conveyor means to move out of the first position and into the second position only after the leading edge of the bundle of sheets has been fed between the second pair of conveyor means.

2. A device as described in claim 1 wherein the control means includes an arm and a drive means, and wherein a top conveyor means of the first pair of driveable conveyor means is rotatably secured to an intermediate part of the arm, a top conveyor means of the second pair of driveable conveyor means is secured to a first end of the arm, and the drive means is connected to a second end of the arm for selectively (a) turning the arm about the nip formed by the first pair of conveyor means, thereby moving the top conveyor means of the second pair of conveyor means between the first and second positions and (b) turning the arm about the nip formed by the second pair of conveyor means, thereby moving the top conveyor means of the first pair of conveyor means between a position in which the first pair of conveyor means are free from one another and a position in which the first pair of conveyor means forms a nip.

3. A device as described in claim 2, wherein the drive means includes a pin which can move along an endless path and fits in a slot formed in the second end of the arm such that upon movement of the pin along the endless path, the following steps successively take place: (a) the arm turns about the nip formed by the second pair of conveyor means until the first pair of conveyor means forms a nip; (b) the arm turns further about the nip formed by the first pair of conveyor means until the second pair of conveyor means are spaced apart, the bundle of sheets being capable of being unobstructedly fed between the second pair of conveyor means; (c) the arm turns back about the nip formed by the first pair of conveyor means until both nips have been formed; and (d) the arm turns back further about the nip formed by the second pair of conveyor means until the pin has completed one trip along the endless path.

4. A device as described in claim 1 including a moveable abutment strip connected to a means for moving it between a first position wherein the sheets being collected to form the bundle are retained in that part of a collecting tray which is situated between the pairs of conveyor means and a second position wherein the sheets are not retained, and wherein the abutment strip moves from the first position into the second position before the bundle is conveyed and is allowed to move back from the second position into the first position before the bundle has been conveyed over a distance equivalent to the distance between the first pair of conveyor means and the second pair of conveyor means.

5. A device as described in claim 2 including a moveable abutment strip connected to a means for moving it between a first position wherein the sheets being collected to form the bundle are retained in that part of a collecting tray which is situated between the pairs of conveyor means and a second position wherein the sheets are not retained, and wherein the abutment strip moves from the first position into the second position before the bundle is conveyed and allowed to move back from the second position into the first position before the bundle has been conveyed over a distance equivalent to the distance between the first pair of conveyor means and the second pair of conveyor means.

6. A device as described in claim 3 including a moveable abutment strip connected to a means for moving it between a first position wherein the sheets being collected to form the bundle are retained in that part of a collecting tray which is situated between the pairs of conveyor means and a second position wherein the sheets are not retained, and wherein the abutment strip moves from the first position into the second position before the bundle is conveyed and is allowed to move back from the second position into the first position before the bundle has been conveyed over a distance equivalent to the distance between the first pair of conveyor means and the second pair of conveyor means.

7. The device as described in claim 2 wherein the first and second pairs of driveable conveyor means comprises a plurality of rollers.

* * * * *